US006739479B2

(12) United States Patent
Contadini et al.

(10) Patent No.: US 6,739,479 B2
(45) Date of Patent: May 25, 2004

(54) DISPENSING SYSTEM

(75) Inventors: Carl D Contadini, Terryville, CT (US); John J. Dean, Oxford, CT (US)

(73) Assignee: Waterbury Companies, Inc., Waterbury, CT (US)

( * ) Notice: Subject to any disclaimer, the term of this patent is extended or adjusted under 35 U.S.C. 154(b) by 13 days.

(21) Appl. No.: 10/118,747

(22) Filed: Apr. 9, 2002

(65) Prior Publication Data

US 2003/0188377 A1 Oct. 9, 2003

(51) Int. Cl.[7] ..... B67D 5/08

(52) U.S. Cl. ..... 222/52; 222/1; 222/144.5; 222/638

(58) Field of Search ..... 222/1, 52, 144.5, 222/638

(56) References Cited

U.S. PATENT DOCUMENTS 5,025,516 A * 6/1991 Wilson ..... 4/623
5,243,326 A 9/1993 Disabato
5,499,016 A 3/1996 Pantus
5,862,844 A * 1/1999 Perrin ..... 141/351
6,039,212 A 3/2000 Singh
6,206,238 B1 * 3/2001 Ophardt ..... 222/1
6,347,414 B2 * 2/2002 Contadini et al. ..... 4/222
6,394,153 B2 * 5/2002 Skell et al. ..... 141/351
RE37,888 E * 10/2002 Cretu-Petra ..... 236/12.12

* cited by examiner

*Primary Examiner*—Gene Mancene
*Assistant Examiner*—Melvin A. Cartagena
(74) *Attorney, Agent, or Firm*—Carmody & Torrance LLP

(57) ABSTRACT

A method of and system for dispensing material from a dispenser into an area of interest, wherein an interrogation step takes place prior to the dispensing of the material for the satisfaction of at least one criterion relating to the presence/absence of one or more objects, and upon the failure to satisfy the at least one criterion, inhibiting the dispensing of the material to be dispensed until the one or more criterions are satisfied.

28 Claims, 3 Drawing Sheets

DISPENSING SYSTEM

BACKGROUND OF THE INVENTION

This invention relates generally to dispensing systems and, in particular, to a dispensing system that interrogates, prior to dispensing material, an area within which the material may be dispensed, for the satisfaction of one or more criterions relating to the presence/absence of one or more objects, such as people, and upon the failure to satisfy the one or more criterions, inhibits the dispensing of the material.

Dispensing systems for the dispensing of materials, such as sanitize conditioning materials, just to name a few, are well known. For example, it is well known to provide dispensing systems for freshening, deodorizing, sanitizing and disinfecting the air within, for example, rest rooms or other areas of interest, to overcome undesirable odors or eliminate contaminants, such as bacteria, in the atmosphere or on and/or around the room's fixtures. Likewise, dispensing systems for the dispensing of insecticides within or about an area of interest are also well known.

Generally speaking, these dispensing systems may be stand-alone devices that may be "time-driven" or "event-driven." An example of the former is an atmospheric dispensing system that includes a timer for controlling the release into the atmosphere of an olfactory simulating material at periodic times. Either continually or during preset hours of operation, a timer triggers the release into the atmosphere of the olfactory simulating material at periodic times of, for example, about 15 minutes. Examples of dispensing systems including these type of "time-driven" controllers are described in U.S. Pat. Nos. 5,772,074, 6,267,297 and 6,039,212, the disclosures of which are incorporated by reference as if fully set forth herein.

An example of the latter "event-driven" dispensing system is described in U.S. Pat. No. 6,347,414, the disclosure of which is also incorporated by reference as if fully set forth herein. In one example, this '414 Patent describes a system that can detect the number of people that enter/exit an area of interest and based thereon, a dispensing device sanitize conditions the medium (i.e. water or air) accordingly.

As would be clear from a reading of any of the aforementioned patents, the prior art recognizes the desirability to have the dispensing systems dispense material, at least apart from the inputting/setting of the dispensing criteria and parameters, without human interaction. That is, it goes without saying that it would be painstakingly inefficient if a person/operator needed to fire the dispenser every time material was needed or desired to be dispensed.

In view thereof, at least one patent describes that undesirable ambient conditions may make such dispensing less than efficient. For example, the aforementioned U.S. Pat. No. 6,039,212 recognizes that under undesirable wind or temperature conditions, dispensing of the material should be inhibited.

The inventors of the present invention have realized that further advancements in the art are desirable. For example, one perceived disadvantage in the known dispensing systems is their inability to monitor and prevent dispensing of material in the event that the presence of objects, such as people, make dispensing undesirable. As a simple example illustrating the problem identified herein, suppose that when a dispenser is set to dispense material, a person is unwittingly standing close to the dispensing unit such that if the dispenser dispensed the material, the person would be exposed to a concentration or spray of material that he/she would have otherwise preferred to avoid. The present state of the art does not in any way provide for the inhibiting of the material under such conditions. As a further example thereof, even a well-placed fragrance dispenser in a restroom could unintentionally "douce" an entrant with an unwanted/undesirable amount of fragrance material.

Similarly, on the insecticide dispensing side, suppose a person or animal is in very close proximity to the dispenser therefor, and further suppose a "time-driven" or "event driven" dispenser, such as those described above, is set to dispense insecticides therefrom. It would be desirable to ensure that the person or animal is not unnecessarily exposed to the insecticide material as it is dispensed.

The present inventors have recognized that such improvements to the state of the art are achievable. As such, the present invention overcomes the perceived deficiencies in the prior art as well as providing the objectives and advantages set forth above and below.

SUMMARY AND OBJECTIVES OF THE INVENTION

Therefore, it is an object and advantage of the present invention to provide an improved dispensing system for dispensing sanitize conditioning materials or insecticides in an area of interest.

It is a further object and advantage of the present invention to provide a dispensing system that interrogates an area of interest prior to the dispensing therein of the material to be dispensed, such as sanitize conditioners, insecticides or the like.

It is a still a further object and advantage of the present invention to provide a dispensing system that interrogates an area of interest for the satisfaction of one or more criterions relating to the presence/absence of one or more objects, and upon the failure to satisfy the one or more criterions, inhibits the dispensing of the material to be dispensed.

It is yet a still further object and advantage of the present invention to provide a dispensing system that can reinterrogate the area of interest for the satisfaction of the one or more criterions, and thereafter continue to reinterrogate until the one or more criterions are satisfied.

Still another object and advantage of the present invention to provide a dispensing system that utilizes an interrogator that can be both connected to or otherwise a part of a dispenser, or one that is physically detachable from the dispenser.

Yet another object and advantage of the present invention to provide a dispensing system that can determine the type of material to be dispensed, and based thereon, adjust the one or more criterions accordingly.

It is still a further object and advantage of the present invention to provide a methodology of using a dispensing system constructed in accordance with the present invention.

Further objects and advantages of this invention will become more apparent from a consideration of the drawings and ensuing description.

The invention accordingly comprises the features of construction, combination of elements, arrangement of parts and methodology that will be exemplified in the disclosure hereinafter set forth, and the scope of the invention will be indicated in the claims.

To overcome the perceived deficiencies in the prior art and to achieve the objects and advantages above and below, the present invention is, generally speaking, directed to a dispensing system for use in an area of interest, such as for example, and not limitation, restrooms, restaurants, eating areas, food stock preparation areas and areas where livestock may be present.

In a preferred embodiment, the system comprises a method of dispensing material from a dispenser, wherein the material to be dispensed is contained in a source of material that is positionable in a housing of the dispenser, and comprises the steps of determining that material is to be dispensed from the source in an area of interest; interrogating, prior to dispensing material, at least a portion of the area of interest for the satisfaction of at least one criterion relating to the presence/absence of one or more objects, and upon the failure to satisfy the at least one criterion, inhibiting the dispensing of the material to be dispensed; reinterrogating the area of interest (or at least a portion thereof) for the satisfaction of the at least one criterion, and repeating this reinterrogation step until the one or more criterions are satisfied; and once the at least one criterion is satisfied, dispensing the material to be dispensed.

Particular features of the method may include initiating the interrogation step after it is determined that material is to be dispensed and determining whether the material to be dispensed is one used primarily as an insecticide, sanitize conditioner, or the like, and setting the at least one criterion based thereon. In a preferred method, the interrogator for interrogating is physically coupled to the dispenser. However, in all embodiments disclosed herein, the present invention contemplates that the interrogator may be physically detached from the dispenser. In this alternative embodiment, the indication that the at least one criterion has been satisfied is transmitted to the dispenser over a communication link, such as over a radio frequency.

In another preferred embodiment, the method comprises the steps of setting an interval for the dispensing of material and interrogating, prior to the end of the interval, an area of interest for the satisfaction of at least one criterion relating to the presence/absence of one or more objects. In yet another methodology, the interrogating occurs after the end of the interval but prior to dispensing.

A system for carrying out the foregoing is also provided, wherein the system comprises a housing unit within which the source of material is positionable; an actuation mechanism for causing the dispensing of material from the source of material; a controller, coupled to the actuation mechanism, for controlling the actuation of the actuation mechanism; an interrogator, coupled to the controller, for interrogating at least a portion of the area of interest and for providing information to the controller relating to the presence/absence of one or more objects; wherein the controller inhibits the actuation of the actuation mechanism based on a failure to satisfy at least one criterion related to the presence/absence of the one or more objects in the area of interest.

In a preferred embodiment, the information the interrogator provides to the controller is the determination of the satisfaction of the at least one criterion. In another preferred embodiment, the controller determines the satisfaction of the at least one criterion based on information provided to the controller from the interrogator. A feature of the present invention is also the ability to provide an interrogator that is physically detached from the housing and communicates with the controller over a radio frequency. Similarly, an arrangement for determining the type of material to be dispensed is also provided.

BRIEF DESCRIPTION OF THE DRAWINGS

The above set forth and other features of the invention are made more apparent in the ensuing Description of the Preferred Embodiments when read in conjunction with the attached Drawings, wherein.

DESCRIPTION OF THE PREFERRED EMBODIMENTS

Figure 1:
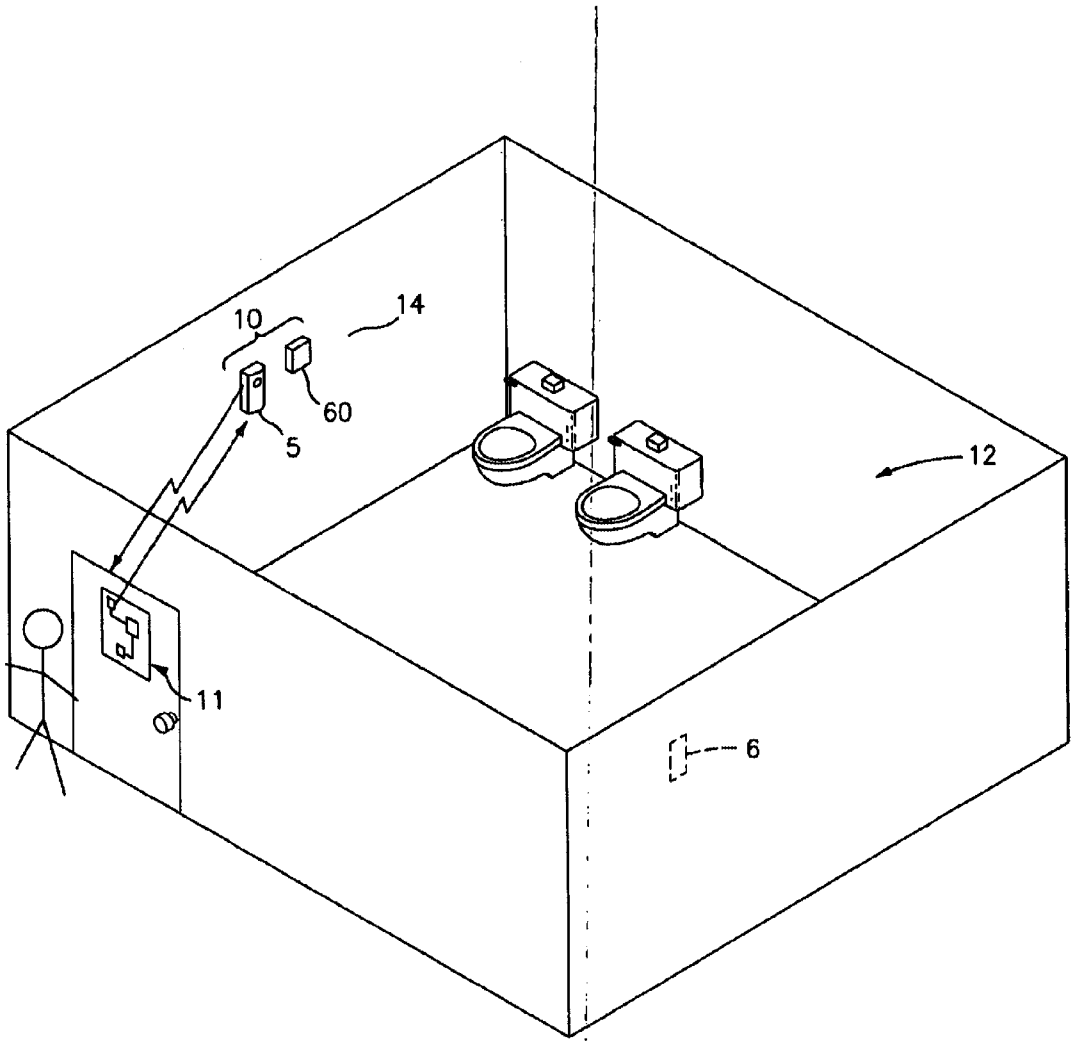
FIG. 1 is a simplified view of an area of interest, illustrating a dispensing system constructed in accordance with the present invention.

Reference is first made to FIG. 1 which illustrates one exemplary area of interest (a restroom 12) wherein a dispensing system, generally indicated at 10, constructed in accordance with the present invention, is disclosed. Other areas of interest, such as those set forth above, are contemplated and covered hereby. In this exemplary environment, dispensing system 10 sanitize conditions the air within area of interest 12. It should be understood that the term "sanitize conditioning" (or a form thereof) should be construed in its broadest sense as a system or device that may freshen, deodorize, sanitizes, disinfect or otherwise condition the air as would be understood in the art. Alternatively, dispensing system 10 may be placed in an area of interest where dispensing of an insecticide is desired/necessary, wherein reference to "insecticide" should also be broadly understood to cover herbicides, pesticides, pheromones, etc. The operation/construction of both systems should be seen as identical.

Dispensing system 10 is shown positioned on a wall 14 and may be used in connection with the remainder of a system, generally indicated at 11, disclosed in U.S. Pat. No. 6,347,414. Reference should be made to U.S. Pat. No. 6,347,414 for the details of the general integration of dispensing system 10 with the system disclosed therein.

Figure 2:
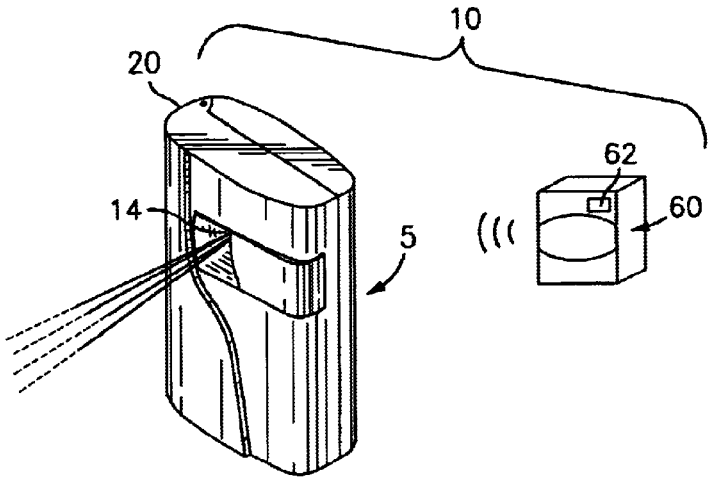
FIG. 2 is a perspective view of a dispensing system constructed in accordance with the present invention, illustrating both a dispensing unit and an interrogator.
Figure 3:
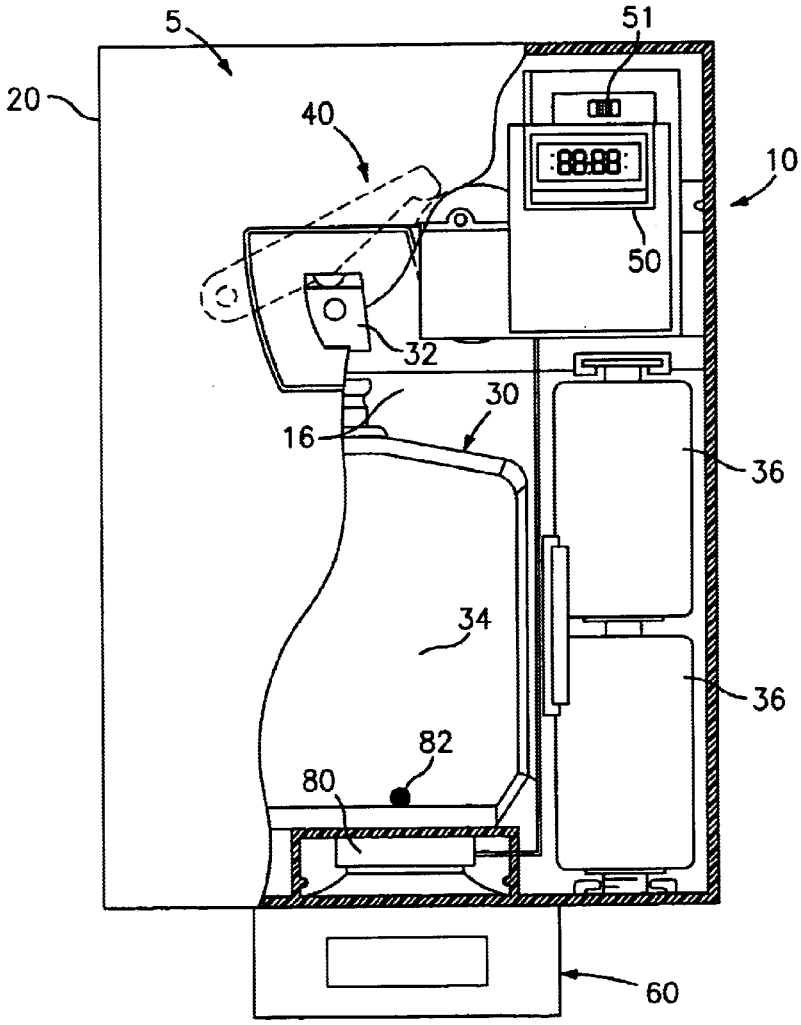
FIG. 3 is a simplified front view of a dispensing system constructed in accordance with the present invention.

Reference is now made to FIGS. 2 and 3 for a more detailed disclosure of the construction of dispensing system 10, although it should be understood that the present disclosure will only focus on the material details of the present invention. For an understanding of the non-material details of the present invention, reference should be had to the disclosures of the patents which have been incorporated herein by reference. However, for completeness and ease of understanding, reference may be made generally to features that may be common to the prior art to better illustrate how they may interact and be incorporated into dispensing system 10.

For example, dispensing system 10 generally comprises a dispenser, generally indicated at 5, itself including a housing 20, which itself includes a vent 14 through which a sanitize conditioning or insecticide material can be expelled into the area of interest surrounding dispenser 5. Housing 20 can be made of any suitable material, such as plastic, acrylonitrile-butadiene-styrene copolymer (ABS), low or high-density polyethylene, polypropylene or medium impact styrene, and can be made by any suitable method, such as by injection molding. The size and shape of housing 20 is not material to the invention, as should be appreciated by one skilled in the art, provided it is capable of functioning in the manner disclosed below.

Housing 20 includes an internal cavity 16 within which a source of sanitize conditioning or insecticide material, generally indicated at 30, can be positioned. Cavity 16 of housing 20 is sized to permit insertion of an appropriate source 30 therein. Source 30 comprises a spray head 32 and a reservoir 34 within which the sanitize conditioning or insecticide material to be dispensed is housed.

System 10 includes an actuation mechanism, generally indicated at 40, for dispensing the sanitize conditioning or insecticide material. Generally, actuation mechanism 40 causes the dispensing of the material by the depression of spray head 32. The construction and operation of actuation mechanism 40 is well known in the art, especially after reading the disclosures incorporated by reference herein, as well as other prior art patents.

For example, a suitable actuation mechanism for use with the present invention is described in U.S. Pat. No. 3,589,563, and therefore this disclosure is also incorporated by reference as if fully set forth herein. Other suitable actuation mechanisms are also disclosed in U.S. Pat. Nos. 4,063,664 and 5,249,718, these disclosures also being incorporated by reference as if fully set forth herein.

Reference to these prior art disclosures will provide the reader with a greater understanding of the workings of the actuating arm and cam (or in the case of U.S. Pat. No. 6,039,212, the use of a solenoid actuated mechanism), all as they relate to the contact and depression of spray head 32.

As would be understood, such mechanisms may be driven by a suitable gearing and motor arrangement (not shown), which are powered by a source of energy, such as batteries 36, or by an a/c arrangement (not shown). All such mechanisms, whether an arm/cam arrangement, solenoid actuated mechanism, or the like, shall be deemed covered by the present invention.

Depressing spray head 32 causes sanitize conditioning or insecticide material to be mechanically expelled, or pumped, through a spray head orifice in spray head 32 and out vent 14 in housing 20. It should also be understood that the sanitize conditioning or insecticide material may include a propellant component, under pressure, such that depressing spray head 32 forces both the sanitize conditioning or insecticide material and propellant through the spray head orifice. Such containers are generally referred to as aerosol containers, the construction of which are well-known in the art. Metered sanitize conditioners or insecticides as well as pump expelled sanitize conditioners or insecticides are also contemplated herein and covered thereby. Accordingly, the illustration of any particular type of source should be considered illustrative only and not in a limited sense.

In accordance with the present invention, a controller 50, operatively coupled to actuation mechanism 40, controls when actuation mechanism 40 is to cause dispensing of the sanitize conditioning or insecticide material from source 30. Controller 50 is operatively coupled to actuation mechanism 40, such as through a suitable circuit (not shown), and can control various aspects of actuation mechanism 40, including days of operation, hours of operation, and frequency of actuation. Examples of other parameters/settings that may be programmed into controller 50 to control actuation mechanism 40 are described in U.S. Pat. No. 6,039,212. In this way, actuation mechanism 40 may dispense sanitize conditioning or insecticide material at certain preset intervals. A suitably designed and implemented controller for use as described above in controlling actuation mechanism 40 would be readily ascertainable by one skilled in the art.

Again, features of dispensing system 10 not material to the present invention, such as for example, the advantageous incorporation of a display for assisting in the programming of controller 50, the incorporation of a keypad to assist therein and means for determining the amount of material that has been dispensed (or for signaling when replacement thereof is necessary or approaching), are omitted herein for purposes of brevity. Similarly, the use of a remote control device, such as one described in the aforementioned U.S. Pat. Nos. 6,039,212 and 6,267,297 may likewise be incorporated into the present invention.

Turning now to the novel features and advantageous of the present invention, it can be seen that dispensing system 10 includes an interrogator, generally indicated at 60. FIG. 3 illustrates one embodiment of the present invention, wherein interrogator 60 is physically connected to dispenser 5 in such a way that communication between interrogator 60 and controller 50 may be achieved at least in part by hard-wiring, while FIG. 2 illustrates how interrogator 60 can be physically detached and separated from housing 20 as disclosed below.

In the case of the latter arrangement, interrogator 60 preferably communicates with controller 50 by RF communication, although clearly other communication protocols, such as IR, sonar, or the like, are contemplated hereby. As such, an interrogator constructed for use in connection with this latter arrangement will have an appropriate RF or IR (or otherwise) transmitter 62, with a corresponding receiver 51 within or operably coupled to controller 50. Interrogator 60 may also have a receiver (with a corresponding transmitter in dispenser 5) so as to know when to begin interrogation, as will be further understood below. That is, transmitter 62 and receiver 51 may each be transceivers.

As stated above, the present inventors recognize that the dispensing units described in the prior art all fail to interrogate the area of interest prior to dispensing material for the purpose of ascertaining, among other things, information regarding the presence/absence of one or more objects in the area of interest. In the most contemplated use of the invention, the objects are people, although animals are also contemplated hereby. Specifically, as noted in Background Section with regard to the deficiencies in the prior art, heretofore it was unknown to ensure that the dispenser was not going to undesirably spray, discharge or otherwise dispense material while people were in the room, in the line of spray or dispensing of the material, or otherwise too close to the dispensing unit at the time of discharge.

Here, interrogator 60 provides information to controller 50 relating to the presence of the one or more objects. It should be understood that the term "presence" should be understood to mean both the presence, or lack thereof, of objects. That is, by virtue of the ability of the interrogator to determine "presence" it is by definition, able to detect for "0" presence, or in other words, an absence of objects. The claims appended hereto should be read with such an interpretation in mind. Depending on the information transmitted by interrogator 60 to controller 50, controller 50 may inhibit the actuation of actuation mechanism 40 until the proper criterion(s) relating to the presence of objects, are satisfied.

The basic functionality of an interrogator that can sense its surroundings in the manner described herein would be well-understood by one skilled in the art. That is, the ability to sense the presence or motion of people in an area of interest is well known, as demonstrated by motion sensors, IR or PIR detectors, or the like, or any combination thereof. For example, motion sensors exist in the security field, to sense the presence of people in a room to turn on a light, or around a car for sounding an alarm. As such, the ability to sense the presence of objects as set forth herein would be understood. In fact, the interrogator may include a photosensor for detecting lightness/darkness or a pressure sensor to sense when a person is in the room by his/her contact therewith. Furthermore, the programming of the interrorgator, in the manner described herein, would be well understood by one skilled in the art.

It is contemplated that criterion(s) relating to the presence (or absence) of one or more objects in the area of interest may be inputted, through the keypad (for example) or at the time of manufacture (by way of another example), into controller 50 (or its associated memory (not shown)).

Examples of such criterions are the desired Interrogation Period and the Interrogation Radius. For example, it may be desired to select from a plurality of values, or otherwise program directly, the Interrogation Period, i.e. 15 seconds, 30 seconds, 45 seconds, etc. Likewise, it would be desirable to select or otherwise program the desired Interrogation Radius, namely, the area around the interrogator that is interrogated thereby, i.e. 5 feet, 10 feet, 20 feet, etc.

Keeping in mind one of the objectives of the present invention is to ensure that objects, such as persons, do not undesirably come into contact or otherwise get sprayed with material as it is dispensed, interrogator 60 will transmit information to controller 50 regarding the presence or absence of objects within a desired radius in the area of interest. This information may be criterion independent, meaning that interrogator 60 merely just informs controller 50 as to what it detects, while leaving it to controller 50 to determine if the criterion(s) is/are satisfied. Alternatively, one or more criterions may be transmitted to interrogator 60 from controller 50 (for example in FIG. 2) in a way that permits the interrogator to determine whether the one or more criterions are satisfied. In this latter configuration, interrogator 60 only has to transmit a signal, such as "DISPENSE," to controller 50 if the criterion(s) is/are satisfied.

For example, one setting of the controller may be such that controller 50 will not allow actuation mechanism 40 to dispense material from source 30 if persons/movement is detected within 2 feet of the interrogator during (i.e. or at anytime within) an "Interrogation Period" of 15 seconds before dispenser 5 is to dispense material. If interrogator 60 does not detect the presence of objects during the "Interrogation Period" within the "Interrogation Radius," dispenser 5 will dispense material accordingly.

In another exemplary setting, controller 50 may not allow actuation mechanism 40 to dispense material from source 30 if persons/movement is detected within ten feet of the interrogator/dispenser during an "Interrogation Period" of 30 seconds before dispenser 5 is to dispense material.

As should be understood, any number of combination of criterions can be used in connection with the present invention. Other criterions are also contemplated hereby.

In one contemplated safety feature of the invention, there may be a programmed or selected minimum for the one or more criterions. For example, a minimum "Interrogation Radius" of 2 feet and "Interrogation Period" of 5 seconds may be automatically programmed into controller 50 or that of interrogator 60. This will provide for a minimum level of protection against undesirable contact with the material to be dispensed.

If the one or more criterions are not satisfied (i.e. interrogator 60 detects the presence of objects within the radius within the predetermined period of time right before an anticipated/desired dispensing), system 10 provides for repeated interrogation by interrogator 60 of the area of interest, such as within the radius criterion set above, until the satisfaction of the one or more criterions. Likewise, during or at the end of this reinterrogation period, controller 50 is receiving and/or will receive information such as the interrogator's readings or a "dispense/no-dispense" signal, from interrogator 60.

As alluded to above, a novel feature and advantage of system 10 is to be able to program/set controller 50 so as to accommodate differing sources of material. In this way, the criterions may be adjustable or customized depending on source 30. Therefore, it would be advantageous for system 10 to be able to determine what type/kind of source is in dispenser 5 prior to any interrogations and dispensings.

Therefore, since the material to be dispensed may be a sanitize conditioner, insecticide, pesticide, herbicide, pheromone or the like, dispenser 5 may include a source identification arrangement for identifying the material in source 30. In this way, system 10 can adjust the one or more criterions based on what the material is in source 30. That is, as stated above, the criterions may be adjusted by the user as the situation or environment dictates. For example the values may be selected from a menu (i.e. a pulldown menu, if available) or may be selected manually and entered into the RAM of the appropriate memory. In addition, with the advantageous feature to now be described, once the dispenser detects what the source of material is, it can automatically adjust the values of the criterions based on the desired parameters.

For this reason, in a preferred embodiment, source identification arrangement comprises a hall-effect sensor, generally indicated at 80. Exemplary sensors in this regard are manufactured by Texas Instruments under the designations TL173L and TL173C, and as such, would be well understood in the art. These sensors are magnetic field sensors designed to provide output voltages proportional to the magnetic field they sense.

As such, the present invention contemplates a mating component, such as metal magnetic ball 82, to be placed into reservoir 34 of source 30 at the time of manufacture of source 30. In this way, depending on the strength of the magnetic field created when source 30 is put into cavity 16, the particular material in source 30 can be identified. That is, each type of source will be correspondingly indicated by the size or number of ball(s) 82, since the magnetic field detected by sensor 80 will change accordingly. Alternatively, a plurality of sensors, each progressively further away from the ball(s) 82 can be used to determine the strength of the field. In this way, if controller 50 knows the anticipated magnetic field created by the respectively sized or number of balls 82, determination of the source 30 by the identification arrangement can be made. One skilled in the art would understand this technique. In a similar manner, although in a somewhat more sophisticated arrangement, identification arrangement may comprise a barcode in place of ball(s) 82 (such as on the bottom of, as opposed to in, reservoir 34) and a reader in place of sensor 80. Other embodiments to achieve this function are clearly contemplated hereby, the operative function being that dispenser 5 can identify source 30. In this way, at least two different types of sources can be identified, thereby being able to have a plurality of sets of criterions, as indicated above.

Figure 4:
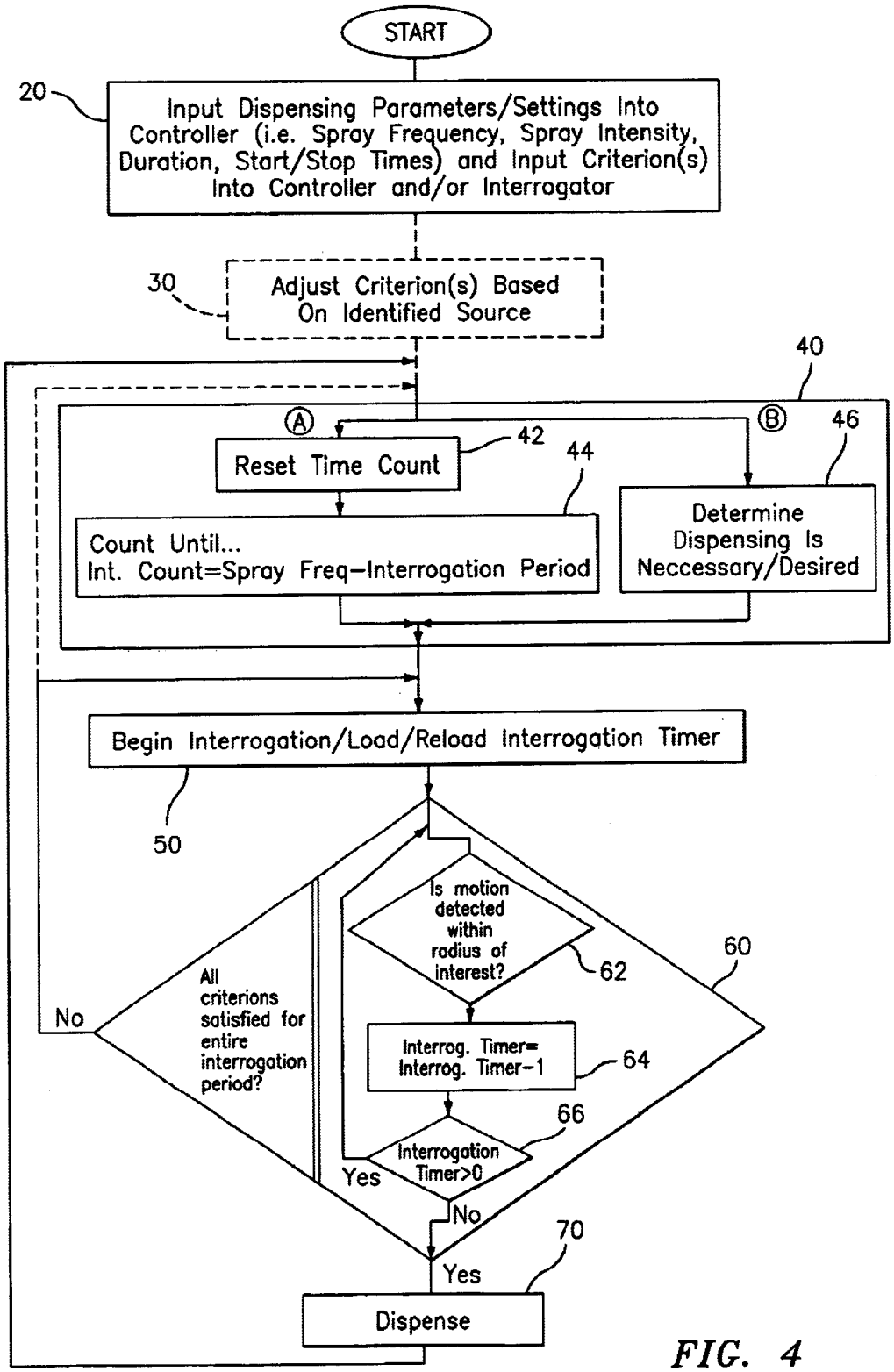
FIG. 4 illustrates a flow diagram of an operating methodology of a dispensing system operating and constructed in accordance with the present invention.

With the construction of system 10 having been disclosed, reference is now made to FIG. 4 in connection with the following disclosure for an understanding of the operation and preferred methodology in connection with the dispensing of material from dispenser 5, wherein the material to be dispensed is contained in source 30 of material that is positionable in housing 20 of dispenser 5. The method will be described in its broadest sense, although it should be understood that not all steps are required to comply with the invention as claimed.

For example, the first step in the disclosed method contemplates the inputting or setting of the dispensing parameters and/or one or more criterions into system 10 (step 20). In the preferred embodiment, these parameters (spray intervals, duration, start/stop) and one or more criterions (Interrogation Period and Radius) will be programmed and stored in a memory of controller 50, and can be inputted therein by way of a remote control device (not shown), directly into a keypad (not shown), or at the time of manufacture, all three methods clearly described in detail in the patents noted herein. In the case where the interrogator 60 is physically detachable from dispenser 5, interrogator 60 may also include a keypad, controller and/or its own internal memory, and it is envisioned that the input parameters/criterions may be stored in interrogator 60. Likewise, depending on the configuration of the system, the parameters/criterions may be transmitted by controller 50 to, and stored in, interrogator 60.

The preferred method also contemplates a step in which system 10 determines what material is in source 30, although this step, among others, is optional, as its performance only enhances the present invention, but does not render it operable. With this feature, the parameters and/or one or more criterions can be adjusted accordingly (step 30). For example, the material to be dispensed may be selected from materials functioning primarily as a sanitize conditioning material or insecticide material. In such an example, the method may comprise the steps (step 30) of determining whether the material to be dispensed is one used primarily as a sanitize conditioner or an insecticide and/or the particular type of source, such as the contents thereof, and setting the one or more criterions based on whether the material to be dispensed is one used primarily as a sanitize conditioning material, an insecticide material or a particular type thereof. In this way, the particulars of source 30 are recognized by the criterions set in the interrogator and/or controller.

The method further comprises the step of determining that material is to be dispensed from source 30 in an area of interest (step 40). Here, the present invention contemplates at least two differing, but not necessarily mutually exclusive, scenarios. First, if system 10 is an "event-driven" system as described in U.S. Pat. No. 6,347,414, then the invention contemplates that, at some point in time, a determination will be made that dispenser 5 should dispense material from source 30 (step 46), such as upon the determination that a threshold level of odor or foot-traffic has been reached. Alternatively, if system 10 is of a more traditional "time-driven" type, then the determination that material is to be dispensed will happen more periodically, such as in intervals of 15 minutes, for example. In such an embodiment, a "Time Counter" may be keeping track of the 15-minute intervals (step 42).

Once it is determined that material is to be dispensed, prior to doing so, and in accordance with a novel feature of the present invention, system 10 interrogates, prior to the dispensing of material, the area of interest (or at least a portion thereof) for the satisfaction of the one or more criterions relating to the presence/absence of one or more objects (such as people, by way of example). Upon the determination by system 10 that there has been an inability (i.e. failure) to satisfy the one or more criterions, system 10 inhibits the dispensing of the material to be dispensed which would otherwise have occurred but for the inhibition feature herein. This broadly disclosed feature may comprise several particular steps, each of which will now be disclosed.

In the example where system 10 is dispensing material on a regular periodic basis (following path A in step 40), system 10 may determine the starting time for the "Interrogation Period" prior to the dispensing time. In this manner, controller 50 (or other controlling means in dispenser 5 or interrogator 60) will know when to begin the interrogation process (step 44). For example, if the "Spray Frequency" equals 15 minutes and the "Interrogation Period" equals 30 seconds, the Time Counter will count from 0 until it reaches 14.5 minutes (15 minutes–30 seconds). At this time, the Interrogation Period will begin (step 50). Likewise, the Interrogation Period may first commence at the 15 minute mark for a period of for example, 30 seconds, and this embodiment is also covered by the claims. As an aside, it should be understood that placing certain substeps in a larger block in FIG. 4 is merely for convenience, and not limitation as to an understanding of their function.

Consistent therewith, if system 10 is more "event-driven" (i.e. path B), the same interrogation process (step 50) will take place once it is determined that dispensing is desired/required (step 46). As would be clear to any programmer, the Interrogation Period may be maintained with a counter for example, counting both up in unit increments or down, as desired.

The determination by system 10 that there has been an inability (i.e. failure) to satisfy the one or more criterions (step 60) may itself comprise several substeps. For example, FIG. 4 illustrates the step of determining whether motion or person(s) is detected, during the "Interrogation Period," within the "Interrogated Radius" (step 62). In this simplified flowchart, a timer may then be incremented/decremented by one unit (step 64). A check of whether this "Interrogation Period" (i.e. the interrogation timer) has expired may then be performed (step 66). Of course, this sequence of steps is only exemplary, as one skilled in the art may configure another equivalent software routine or equivalent component to achieve the functionality set forth herein.

The outcome of decision step 60, as well as decision substeps 62, 66, are set forth in the flowchart, although for completeness, it is stated that the disclosed substeps 62, 64, 66 check if, as in this case, there is motion within the "Interrogation Radius" during the "Interrogation Period." If there is no motion, dispenser 5 will dispense material at the end of the "Interrogation Period" (step 70) and in accordance with the determination step 40.

However, if there is an amount of detected motion or number of people that would cause failure of the satisfaction of the criterion(s), the methodology preferably causes the return to one of steps 40 or 50.

That is, once there is a determination that the one or more criterions were not satisfied (step 60), the disclosed method preferably reinterrogates the area of interest for the satisfaction of the one or more criterions. This reinterrogation step is preferably repeated until the one or more criterions are satisfied. To achieve this step, from step 60 the flowchart is seen to return to either step 40 or 50. In the latter case, there is a resetting of the "Interrogation Timer" and the reinterrogation of the area of interest in accordance with step 60. In this way, since system 10 "wants" to dispense material in accordance with step 40, the reinterrogation takes place until the one or more criterions are satisfied.

Alternatively, one or more intermediate steps may be repeated if, from step 60, the sequence returns to step 40. In this case, the invention recognizes that the dispensing of the material at the necessary/desired time of step 40 will be "skipped." In this way, it can be seen that in a "time-based" system, for example, dispensing of material may not occur for about 30 minutes if, at the first 15 minute interval, the one or more criterions were not satisfied. Although both alternatives fall within the claimed invention, it can be seen that reinterrogating the area of interest (i.e. returning to step 50) until the one or more criterions are satisfied, is preferable. A manual switch or a program mode can allow for the selectability of this option (i.e. whether to skip the dispensing step or merely delay it until the one or more criterions are satisfied).

In either alternative, once the one or more criterions are satisfied, the material can be dispensing (step 70).

As can be seen from the foregoing disclosure, the interrogation step (step 60) is preferably initiated after it is determined that material is to be dispensed, whether the determination is "event-driven" or "time-driven," and the interrogation takes place for a predetermined period of time (step 64) as determined by the criterion "Interrogation Period" and set by the value in the interrogation timer, which can be set for example, at step 20. Again, in a "time driven" unit, the Interrogation Period my take place prior to or after the 15 minute (exemplary) spray frequency interval.

The "Interrogation Period" may vary as desired. Likewise, the period of time for which the reinterrogation takes place can, and is preferably, the same period of time for the initial "Interrogation Period," for example, 15 seconds, 30 seconds, etc. However, this is by example and not limitation, as the reinterrogation periods may also differ from the initial period, if desired. This would merely entail an additional (or adjusting of) the interrogation timer, all modifications well within the purview of one skilled in the art.

If the determination of the satisfaction (or failure thereof) of the one or more criterions takes place in interrogator 60, then the method would preferably include the step of transmitting, to dispenser 5 (and preferably controller 50 thereof), the indication that the one or more criterions have been satisfied. This may be as simply as transmitting a "dispense" signal. The transmission of such a signal is preferably transmitted to dispenser 5 from interrogator 60 over a radio frequency.

On the other hand, the determination of the satisfaction (or failure thereof) of the one or more criterions may take place within dispenser 5 (i.e. controller 50). In this example, the method would preferably include the step of transmitting, to controller 50, the values of the information detected so that controller 50 can process the information accordingly. Broadly speaking, however, the methodology of the invention in both alternatives is the same.

It should be noted that the actual "Spray Frequency" may be changing in the "time-driven" system, since delays in dispensing, determined by the need to reinterrogate, may result in a spray frequency more/less than that programmed, i.e. 15 minutes. Depending on the desired configuration, the method disclosed herein contemplates adjustments therein. For example, the flowchart envisions that, if the "Spray Frequency"=15 minutes, the next dispensing will not occur, at the earliest, until 15 minutes after the last dispensing. To do otherwise, while contemplated herein, could result in a subsequent dispensing being undesirably close together in time should an interrogation processes be repeated several times and the "Time Counter" counter being incremented simultaneously therewith. Therefore, it is preferred that the length of time the material was inhibited from being dispensed is taken into account in determining the time prior to the next dispensing.

Although, as noted, the present invention can be operated by the use of a single software code present in controller 50, a controller (not shown) in interrogator 60, or even one distributed therebetween, it will be understood that the individual functions thereof can be separately effected, either electronically, mechanically, or by the provision of separate processors having individual responsibility, as would be familiar to the skilled artisan upon review of this description. In addition, the precise logic to be used to set the parameters/criterion(s) can vary and are not restricted to the foregoing.

Although described in the context of preferred embodiments, it should be realized that a number of modifications to these teachings may occur to one skilled in the art. Although this disclosure is written in terms of dispensing a sanitize conditioning material or insecticide material, such is by way of example only. It should be understood that the present invention applies to a dispenser for any dispensable material, including, but not limited to, antistatic agents, pesticides, herbicides, bactericides and "olfactory stimulating material" (i.e. a material which affects the olfactory response to the environment of a room or like space) such as fragrances, perfumes or deodorizing components. Also, the area of interest in which movement/objects are detected may be the same or different than that interrogated by interrogator 60. For example, clearly if the dispenser is to dispense a material in a room, while the interrogation is to take place only for a 2 foot radius, clearly the size of the "area of interest" may, or may not, differ. Also, the actual areas of interest may differ depending on whether interrogator 60 is mounted to or separate from dispenser 5 (FIG. 2 vs. FIG. 3).

While the invention has been particularly shown and described with respect to preferred embodiments thereof, it will be understood by those skilled in the art that changes in form and details may be made therein without departing from the scope and spirit of the invention. For example, multiple interrogators and multiple dispensers may be incorporated into the system, although only one dispenser and one interrogator is needed to meet the claims. As illustrated in FIG. 1 for example, one interrogator 60 is illustrated although a plurality of dispensers 5, 6 are depicted. That is, more than one dispenser is contemplated for use with one interrogator. Additionally, the present invention also contemplates a dispenser having a cavity for holding both an insecticide product and an sanitize conditioning product. Dispensing may be simultaneous or staggered, as desired, all of which can be performed in accordance with the invention disclosed herein. Lastly, reference herein to "interval(s)" are meant most generally as to time intervals, and thus intervals calculated on the basis of pulses, seconds or the like, whether considered identical or not, are all contemplated herein and covered in the claims as the use of the term "interval" is only limited by the understanding that it is a period between dispensings.

What is claimed is:

1. A method of dispensing material from a dispenser, wherein the material to be dispensed is contained in a source of material that is positionable in a housing of the dispenser, the method comprising the steps of:

determining that material is to be dispensed from the source in an area of interest;

interrogating, prior to dispensing material, at least a portion of the area of interest to determine whether one or more objects are present in the interrogated portion of the area of interest and inhibiting the dispensing of the material to be dispensed if the one or more objects are present in the interrogated portion of the area of interest;

reinterrogating at least a portion of the area of interest to determine whether the one or more objects are still present in the reinterrogated portion of the area of interest, and repeating this reinterrogation step until the one or more objects are no longer present in the reinterrogated portion of the area of interest; and dispensing the material to be dispensed once the one or more objects are no longer present in at least the reinterrogated portion of the area of interest.

2. The method as claimed in claim 1, wherein the interrogation step is initiated after it is determined that material is to be dispensed, and the interrogation takes place for a predetermined period of time.

3. The method as claimed in claim 2, wherein the predetermined period of time is at least 15 seconds.

4. The method as claimed in claim 1, wherein the reinterrogation takes place for a second predetermined period of time.

5. The method as claimed in claim 4, wherein the second predetermined period of time is at least 15 seconds.

6. The method as claimed in claim 1, including the step of:

transmitting to the dispenser, from a physically detached interrogator, the indication that the one or more objects are no longer present in the reinterrogated portion of the area of interest.

7. The method as claimed in claim 6, wherein the indication that the one or more objects are no longer present in at least the reinterrogated portion of the area of interest is transmitted to the dispenser from the interrogator over a radio frequency.

8. A method of dispensing material from a dispenser, wherein the material to be dispensed is contained in a source of material that is positionable in a housing of the dispenser, the method comprising the steps of:

setting an interval for the dispensing of material to be dispensed in an area of interest, wherein the dispensing of material is to occur at the end of the interval;

interrogating, prior to the end of the interval, at least a portion of the area of interest to determine whether one or more objects are present in the interrogated portion of the area of interest and inhibiting the dispensing of the material to be dispensed at the end of the interval if the one or more objects are present in the interrogated portion of the area of interest;

reinterrogating at least a portion of the area of interest to determine whether the one or more objects are still present in the reinterrogated portion of the area of interest, and repeating this reinterrogation step until the one or more objects are no longer present in the reinterrogated portion of the area of interest; and dispensing the material to be dispensed once the one or more objects are no longer present in the reinterrogated portion of the area of interest.

9. A method of dispensing material from a dispenser, wherein the material to be dispensed is contained in a source of material that is positionable in a housing of the dispenser, the method comprising the steps of:

setting an interval for the dispensing of material to be dispensed in an area of interest;

interrogating, prior to the end of the interval, at least a portion of the area of interest for the satisfaction of at least one criterion relating to the presence/absence of one or more objects, and upon the failure to satisfy the at least one criterion, inhibiting the dispensing of the material to be dispensed at the end of the interval;

reinterrogating at least a portion of the area of interest for the satisfaction of the at least one criterion, and repeating this reinterrogation step until the at least one criterion is satisfied;

once the at least one criterion is satisfied, dispensing material to be dispensed; and readjusting the interval to take into account the length of time the material was inhibited from being dispensed.

10. A method of dispensing material from a dispenser, wherein the material to be dispensed is contained in a source of material that is positionable in a housing of the dispenser, the method comprising the steps of:

setting an interval for the dispensing of material to be dispensed in an area of interest;

interrogating, after the end of the interval but prior to dispensing, at least a portion of the area of interest to determine whether one or more objects are present in the portion of the area of interest and inhibiting the dispensing of the material to be dispensed if the one or more objects are present in the interrogated portion of the area of interest;

reinterrogating at least a portion of the area of interest to determine whether the one or more objects are still present in the reinterrogated portion of the area of interest and repeating this reinterrogation step until the one or more objects are no longer present in the reinterrogated portion of the area of interest; and dispensing the material to be dispensed once the one or more objects are no longer present in the reinterrogated portion of the area of interest.

11. A system for dispensing material from a source of material into an area of interest, the system comprising:

a housing unit within which the source of material is positionable;

an actuation mechanism for causing the dispensing of material from the source of material;

a controller, coupled to the actuation mechanism, for controlling the actuation of the actuation mechanism;

an interrogator, coupled to the controller, for interrogating at least a portion of the area of interest, and for providing information to the controller relating to the presence/absence of one or more objects in the interrogated portion of the area of interest;

wherein the controller inhibits the actuation of the actuation mechanism until it is determined that the one or more objects are no longer present in the interrogated portion of the area of interest.

12. The system as claimed in claim 11, wherein the controller determines that material is to be dispensed from the source in an area of interest and the interrogating by the interrogator takes place prior to the dispensing of material.

13. The system as claimed in claim 11, wherein the controller maintains an interval for the dispensing of material to be dispensed in the area of interest and the initial interrogating by the interrogator takes place prior to the end of the interval.

14. The system as claimed in claim 11, including means for determining the material to be dispensed.

15. The system as claimed in claim 11, wherein the controller maintains an interval for the dispensing of material to be dispensed in the area of interest and the initial interrogating by the interrogator takes place prior to the end of the interval.

16. The system as claimed in claim 15, wherein the controller readjusts the interval to take into account the length of time the material was inhibited from being dispensed.

17. The system as claimed in claim 11, wherein the controller maintains an interval for the dispensing of material to be dispensed in the area of interest and the initial interrogating by the interrogator takes place after the end of the interval and prior to dispensing of the material.

18. The system as claimed in claim 11, wherein the interrogator is physically detached from the housing.

19. A system for dispensing material from a source of material into an area of interest, the system comprising:

a housing unit within which the source of material is positionable;

an actuation mechanism for causing the dispensing of material from the source of material;

a controller, coupled to the actuation mechanism, for controlling the actuation of the actuation mechanism;

an interrogator, coupled to the controller, for interrogating at least a portion of the area of interest prior to the dispensing of material, and for providing information to the controller relating to the presence/absence of one or more objects;

wherein the controller:

inhibits the actuation of the actuation mechanism based on a failure to satisfy at least one criterion related to the presence/absence of the one or more objects in the interrogated portion of the area of interest, maintains an interval for the dispensing of material to be dispensed in the area of interest and the initial interrogating by the interrogator takes place prior to the end of the interval, and readjusts the interval to take into account the length of time the material was inhibited from being dispensed.

20. A system for dispensing material from a source of material into an area of interest, the system comprising:

a housing unit within which the source of material is positionable;

an actuation mechanism for causing the dispensing of material from the source of material;

a controller, coupled to the actuation mechanism, for controlling the actuation of the actuation mechanism;

an interrogator, coupled to the controller, for interrogating at least a portion of the area of interest prior to the dispensing of material, and for providing information to the controller relating to the presence/absence of one or more objects;

wherein the controller:

inhibits the actuation of the actuation mechanism based on a failure to satisfy at least one criterion related to the presence/absence of the one or more objects in the interrogated portion of the area of interest, and maintains an interval for the dispensing of material to be dispensed in the area of interest and the initial interrogating by the interrogator takes place after the end of the interval and prior to dispensing of the material.

21. The system as claimed in claim 20, wherein the interrogator provides repeated interrogation of at least a portion of the area of interest until the satisfaction of the at least one criterion.

22. The system as claimed in claim 20, wherein the information the interrogator provides to the controller is the determination of the satisfaction of the at least one criterion.

23. The system as claimed in claim 20, wherein the controller determines the satisfaction of the at least one criterion based on information provided to the controller from the interrogator.

24. A system for dispensing material from a source of material into an area of interest, the system comprising:

a housing unit within which the source of material is positionable;

an actuation mechanism for causing the dispensing of material from the source of material;

a controller, coupled to the actuation mechanism, for controlling the actuation of the actuation mechanism;

an interrogator, coupled to the controller, for interrogating at least a portion of the area of interest prior to the dispensing of material, and for providing information to the controller relating to the presence/absence of one or more objects;

wherein the controller inhibits the actuation of the actuation mechanism based on a failure to satisfy at least one criterion related to the presence/absence of the one or more objects in the interrogated portion of the area of interest;

wherein the interrogator is physically detached from the housing and communicates with the controller over a radio frequency.

25. The system as claimed in claim 24, wherein the material to be dispensed is selected from the group consisting of materials that function primarily as an insecticide or a sanitize conditioner, and wherein the system comprises:

means for determining whether the material to be dispensed is one used primarily as an insecticide or a sanitize conditioner; and wherein the system adjusts the at least one or more criterion based on whether the material to be dispensed is one used primarily as an insecticide or sanitize conditioner.

26. A dispenser for dispensing material from a source of material into an area of interest, wherein the dispenser is part of a system that comprises an interrogator for interrogating at least a portion of the area of interest prior to the dispensing of material, and for providing information to the dispenser relating to the presence/absence of one or more objects, wherein the dispenser comprises:

a housing unit within which the source of material is positionable;

an actuation mechanism for causing the dispensing of material from the source of material;

a controller, in communication with the interrogator and coupled to the actuation mechanism, for controlling the actuation of the actuation mechanism;

wherein the controller inhibits the actuation of the actuation mechanism until it is determined that the one or more objects are no longer present in the interrogated portion of the area of interest.

27. A system for dispensing material from a source of material into an area of interest, the system comprising:

a housing unit within which the source of material is positionable;

dispensing means for causing the dispensing of material from the source of material;

controlling means, coupled to the dispensing means, for controlling the actuation of the dispensing means;

means, coupled to the controlling means, for interrogating at least a portion of the area of interest, and for providing information to the controlling means relating to the presence/absence of one or more objects in the interrogated portion of the area of interest;

wherein the controlling means inhibits the actuation of the dispensing means until it is determined that the one or more objects are no longer present in at least the interrogated portion of the area of interest.

28. A dispenser for dispensing material from a source of material into an area of interest, wherein the dispenser is part of a system that comprises an interrogator for interrogating at least a portion of the area of interest prior to the dispensing of material, and for providing information to the dispenser relating to the presence/absence of one or more objects, wherein the dispenser comprises:

a housing unit within which the source of material is positionable;

dispensing means for causing the dispensing of material from the source of material;

controlling means, in communication with the interrogator and coupled to the dispensing means, for controlling the actuation of the dispensing means;

wherein the controlling means inhibits the actuation of the dispensing means until it is determined that the one or more objects are no longer present in at least the interrogated portion of the area of interest.

* * * * *